US006086467A

United States Patent [19]

Imai et al.

[11] Patent Number: 6,086,467

[45] Date of Patent: Jul. 11, 2000

[54] GRINDING WHEEL

[75] Inventors: Tomoyasu Imai, Kariya; Ryohei Mukai, Nagoya; Shinji Soma, Handa; Tomoyuki Kasuga; Takanori Ninomiya, both of Kariya, all of Japan

[73] Assignees: Toyoda Koki Kabushiki Kaisha, Kariya; Toyoda Van Moppes Kabushiki Kaisha, Okazaki, both of Japan

[21] Appl. No.: 09/106,851

[22] Filed: Jun. 30, 1998

[30] Foreign Application Priority Data

Jun. 30, 1997 [JP] Japan ..... 9-190670

[51] Int. Cl.[7] ..... B24D 3/34

[52] U.S. Cl. ..... 451/541; 451/309

[58] Field of Search ..... 451/541, 548, 451/540, 309, 293

[56] References Cited

U.S. PATENT DOCUMENTS 5,454,750 10/1995 Cosmano et al. ..... 451/526

FOREIGN PATENT DOCUMENTS 2019377 1/1987 Japan ..... 51/309
0062347 12/1988 Japan ..... 51/309
2269567 11/1990 Japan ..... 51/309
3228578 10/1991 Japan ..... 51/309

*Primary Examiner*—Robert A. Rose
*Attorney, Agent, or Firm*—Oblon, Spivak, McClelland, Maier & Neustadt, P.C.

[57] ABSTRACT

A grinding wheel comprising abrasive grains, a bonding material for bonding the abrasive grains, and grain clusters of accumulated filler grains having a size smaller than the abrasive grains. The grinding wheel may be a vitrified grinding wheel, and in this case, chromium oxide having good affinity with the vitrified bonding material may be used as the filler grains.

3 Claims, 4 Drawing Sheets

GRINDING WHEEL

FIELD OF THE INVENTION

The present invention relates to a grinding wheel, and particularly relates to a vitrified grinding wheel in which superabrasive grains such as cubic boron nitride (CBN) grains or diamond grains are retained or bound with a vitrified bonding material.

BACKGROUND OF THE INVENTION

When a material that is easily bent, such as, for example, a workpiece with a small diameter, is ground with a grinding wheel using superabrasive grains such as cubic boron nitride (CBN) grains or diamond grains, the distances among the abrasive grains are made large because the grinding force must be reduced. Specifically, as shown in FIG. 1, a filler composed of alumina ($Al_2O_3$) is mixed with a bonding material (vitrified bonding material), and the superabrasive grains are retained with such a bonding material (vitrified bonding material) with suitable distances to uniformly disperse the superabrasive grains.

In the above-described prior art where alumina ($Al_2O_3$) grains 20 as a filler are mixed with a bonding material 30 composed of the vitrified bonding material as shown in FIG. 1, since the alumina grains 20 composed of relatively small grains are uniformly present around the superabrasive grains 10, the distances among the superabrasive grains 10 at the grinding surface is determined by the grain size of the alumina ($Al_2O_3$) grains 20 but cannot be widened as expected. Because the affinity between alumina and the vitrified bonding material is not high, the filler composed of the alumina grains 20 is easily dropped from the vitrified bonding material 30 in grinding work as shown in FIG. 2. As a result, the bonding force of the vitrified bonding material 30 is reduced by the dropping of the filler 20, and the bonding force to retain the superabrasive grains 10 is also reduced. Therefore, a problem arises where the superabrasive grains 10 are dropped in an early stage.

SUMMARY OF THE INVENTION

An object of the present invention is to provide a grinding wheel in which a bonding force of abrasive grains is improved.

Another object of the present invention is to provide a grinding wheel in which dropping of a filler in an early stage is prevented.

The grinding wheel of the present invention comprises abrasive grains, a bonding material for bonding the abrasive grains, and grain clusters of accumulated filler grains having a size smaller than the abrasive grains.

In this constitution, since a grain cluster of accumulated filler grains forms a filler grain, grain clusters (i.e., filler) having a desired size can be obtained by selecting or adjusting the accumulated amount of the filler grains. Since the distances among the abrasive grains are adjusted by using such grain clusters having the adjusted size, a grinding wheel can be produced in which the desired distances among the abrasive grains can be retained and the abrasive grains are uniformly contained. Thus, a grinding wheel with small grinding force can be produced.

Furthermore, when the grinding wheel is used to work, the grains constituting the grain clusters are dropped individually, but the filler is not dropped as an aggregate. Thus, the dropping of the abrasive grains in an early stage is prevented, and the abrasive grain-bonding force of the bonding material is maintained for a long time. Therefore, grinding burn can be prevented and working precision is improved as a result.

The grinding wheel of the present invention realizes both quality improvement in producing grinding wheel and quality improvement in using grinding wheel at the same time.

As one preferred embodiment, when the grinding wheel is a vitrified grinding wheel, chromium oxide ($Cr_2O_3$) can be used as the filler grains. The grains of chromium oxide ($Cr_2O_3$) has better affinity with the vitrified bonding material used as the bonding material than alumina ($Al_2O_3$) having been used as a filler, and therefore the filler grains and the vitrified bonding material are present in a fused state in the grinding wheel. As a result, dropping of a filler in an early stage is prevented, and the bonding force of abrasive grains is improved.

DETAILED DESCRIPTION OF THE PREFERRED EMBODIMENT

Figure 1:
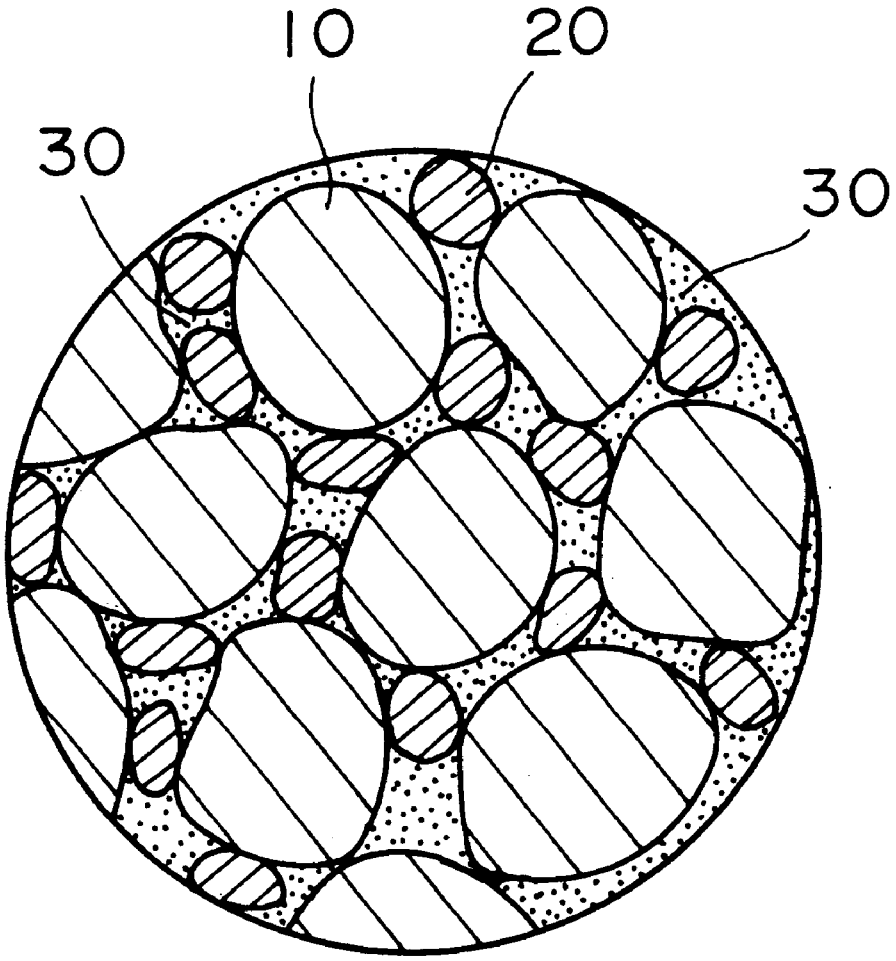
FIG. 1 (PRIOR ART)
FIG. 1 is a transversal cross-sectional view showing the overall constitution of the prior art.
Figure 2:
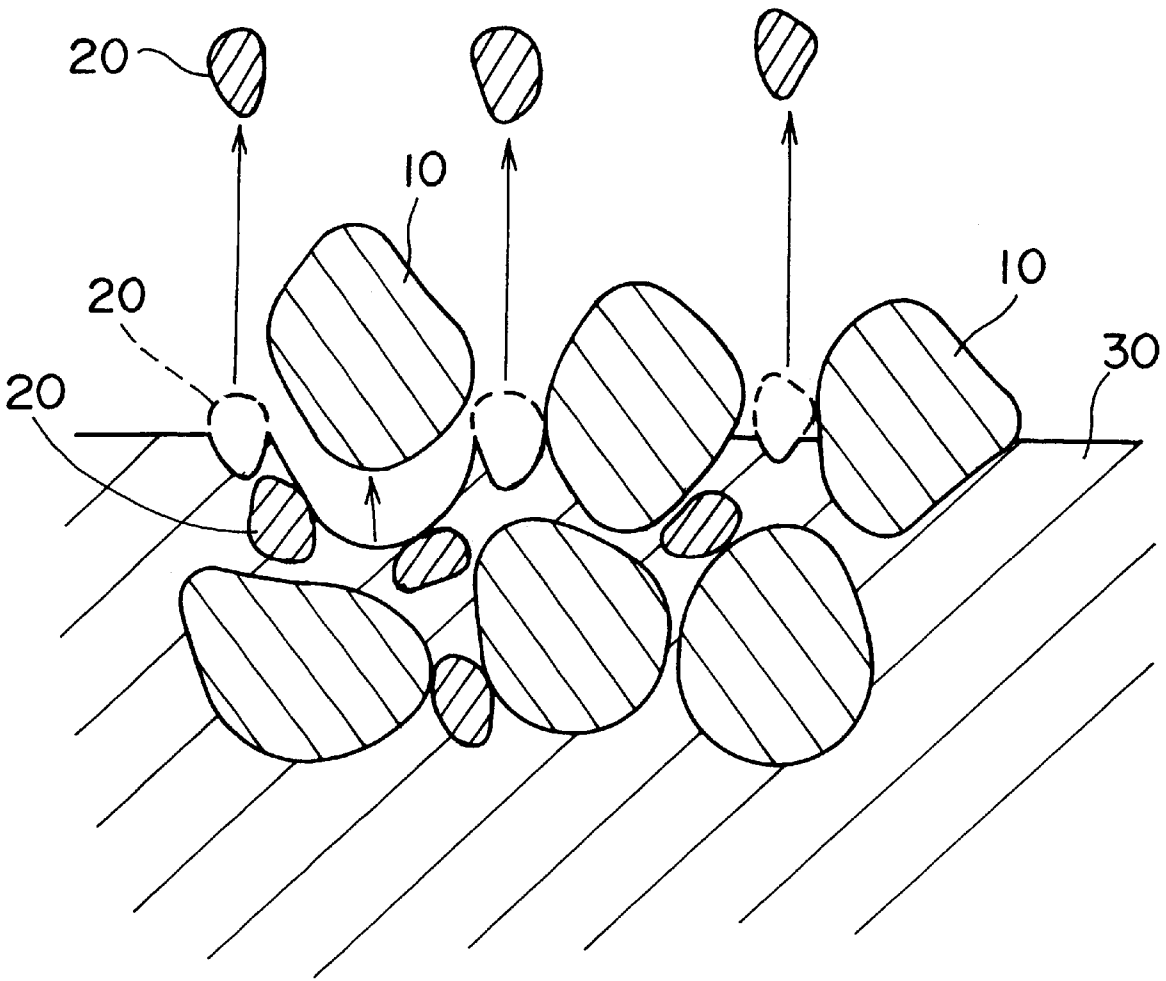
FIG.2 (PRIOR ART)
FIG. 2 is a cross-sectional view showing the overall constitution and the state of functioning of the prior art.
Figure 3:
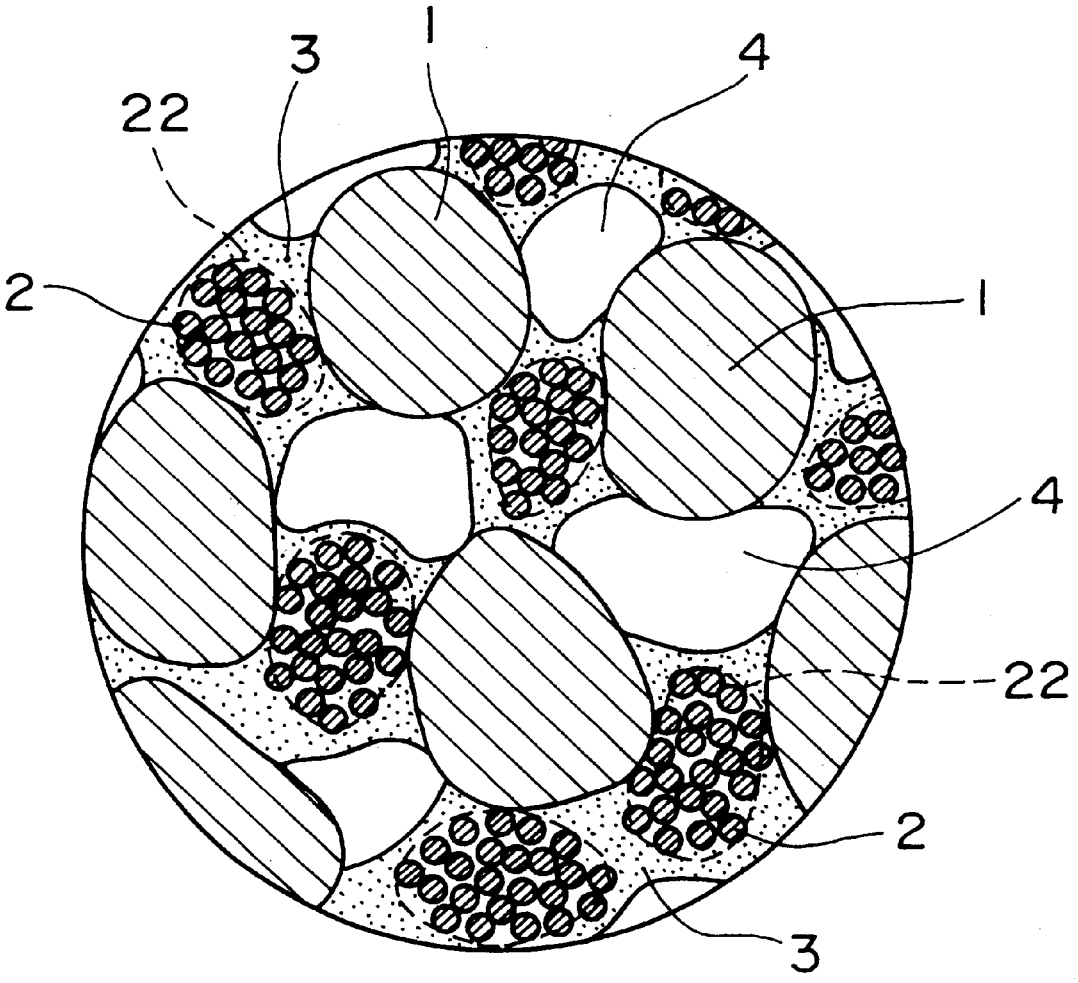
FIG. 3 is a transversal cross-sectional view showing the overall constitution of one embodiment of the present invention.

A preferred embodiment of the present invention is described with reference to FIG. 3 and FIG. 4. one embodiment of the grinding wheel of the present invention shown in FIG. 3 basically comprises abrasive grains 1 composed of superabrasive grains, e.g., cubic boron nitride (CBN) grains or diamond grains; a bonding material 3 composed of a vitrified bonding material for bonding and retaining the abrasive grains 1; filler grains 2 filled in the bonding material 3 and having a nature of good affinity with the vitrified bonding material constituting the bonding material 3; and pores 4.

In such a basic constitution, the filler grains 2 are employed that have good affinity with the vitrified bonding material and a fairly smaller size than the abrasive grains 1. Particularly, in this embodiment, small grains of the filler grains 2 are used, and at the same time, they are present in a state where a plurality of them are accumulated as one cluster as shown in FIG. 3. Thus, each grain having a size (grain size) of from 5 to 50 $\mu$m are used. Furthermore, while the clusters obtained by accumulation of small grains or fine grains intervene in the bonding material 3 as shown in FIG. 3, the diameter of the grain clusters 22 in an accumulated state is made ⅓ or more, preferably about a half, of the grain size of the abrasive grains 1. The thus formed grain clusters 22 each functions as a filler.

A method for obtaining the grains clusters 22 having the desired size includes a method in which grain clusters formed by spontaneous accumulation of chromium oxide ($Cr_2O_3$) grains are sieved to obtain grain clusters having the desired size, and a method in which grains are forcedly accumulated to the desired size by using wax.

As the filler grains, 2 present in an accumulated state in the bonding material 3, this embodiment employs chromium oxide ($Cr_2O_3$) grains, a representative of those having good affinity with the bonding material. The volume ratio of the chromium oxide ($Cr_2O_3$) is preferably 20% or more based on the whole of filler contained in the grinding wheel. The abrasive grains (superabrasive grains) 1, the vitrified bonding material constituting the bonding material 3, and the filler grains 2 which are chromium oxide fine grains having a nature of excellent affinity with the vitrified bonding material are suitably mixed and baked at a predetermined temperature, and a vitrified grinding wheel having a predetermined distances among the abrasive grains and the pores 4 is produced.

The functions and effects of this embodiment are described below. The chromium oxide ($Cr_2O_3$) grains used as the filler grains 2 have good affinity with the vitrified bonding material constituting the bonding material 3, and are present in the bonding material 3 in a state where they are well fused with the vitrified bonding material. Thus the dropping of the filler grains 2 in an early stage is prevented in comparison to the prior art using alumina ($Al_2O_3$) as the filler grains 2. As a result, the bonding force and retaining force of the bonding material 3 are also firmly maintained, and the dropping of the abrasive grains 1 in an early stage is also prevented. Because of these, grinding burn at the grinding surface is prevented.

Figure 4:
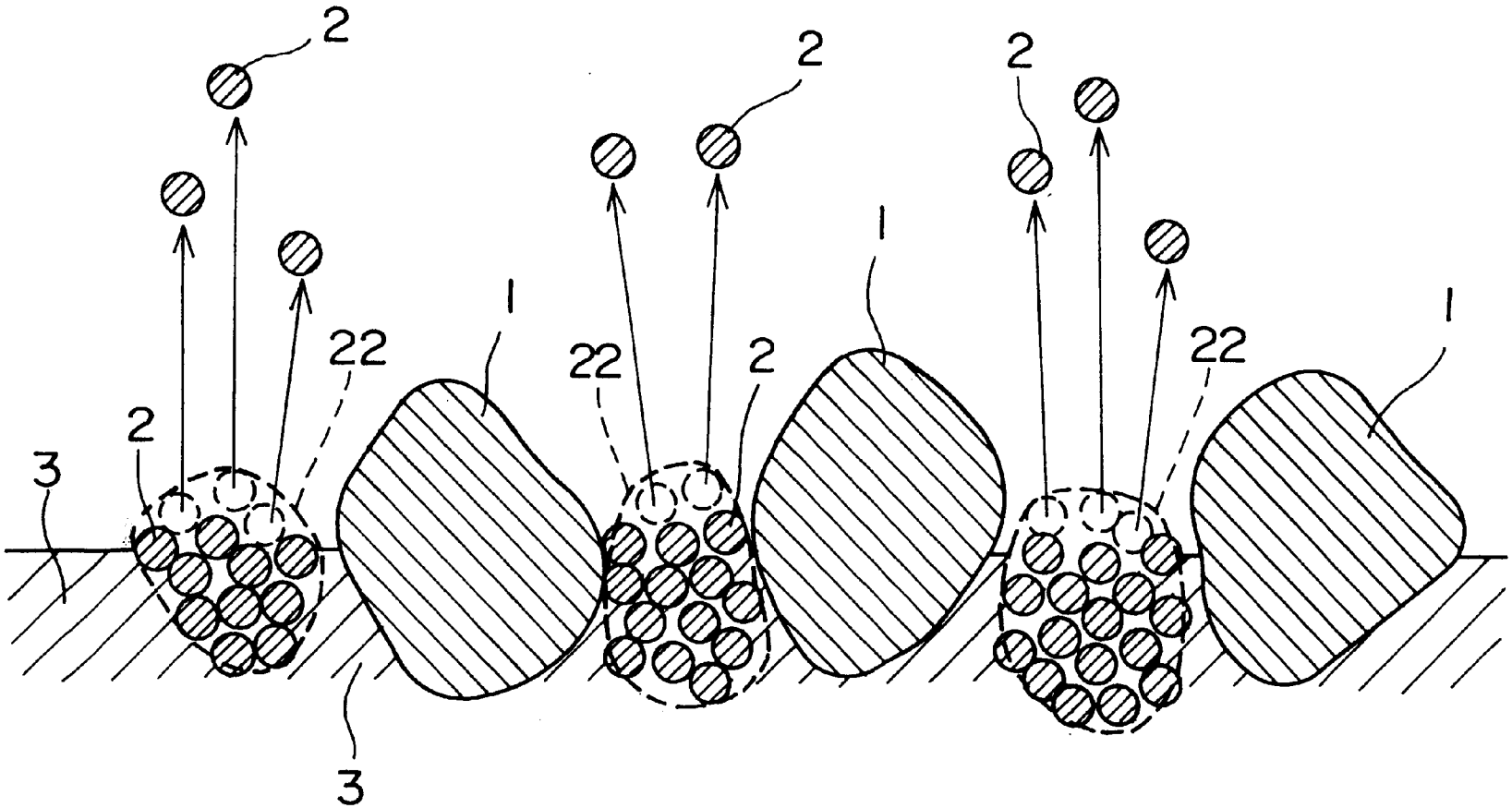
FIG. 4 is a cross-sectional view showing the overall constitution and the state of functioning of one embodiment of the present invention.

Since the filler grains having a size of from 5 to 50 $\mu$m are used, even though the filler grains 2 are dropped from the bonding material 3, they are dropped as individual filler grains 2 as shown in FIG. 4, but are not dropped as an aggregate of filler grains at once. Thus, the adverse influence to the bonding material 3 is depressed. As a result, the retaining force of the bonding material 3 is sufficiently maintained, and the dropping of the abrasive grains 1 in an early stage is prevented. Since the filler grains 2 composed of fine grains are present in the bonding material 3 in a state where they are accumulated to some extent as an aggregate as shown in FIG. 3 and FIG. 4, reinforcement of the bonding material 3 is attained. Thus, the abrasive grains 1 are firmly retained, and the dropping of the abrasive grains 1 in an early stage is prevented.

Because the size of the grain clusters 22 composed of the accumulated filler grains 2 is ⅓ or more of the size of the abrasive grains 1, the distances among the abrasive grains 1 retained by the bonding material 3 containing the aggregates of filler (grain clusters) 22 are sufficiently secured. A vitrified grinding wheel having an abrasive grain distance sufficiently secured is produced as a result, and grinding work with good efficiency can be achieved by conducting grinding with the use of such a grinding wheel. Furthermore, since the bonding material 3 is reinforced by the filler grains 2 and the grain clusters 22 formed by the filler grains 2, the dropping of the abrasive grains 1 in an early stage is prevented.

In this embodiment, it is not required that the whole of the filler contained in the grinding wheel is composed of the grains cluster 22, but conventional fillers may be used in combination.

While the invention has been described in detail and with reference to specific embodiments thereof, it will be apparent to one skilled in the art that various changes and modifications can be made therein without departing from the spirit and scope thereof.

What is claimed is:

1. A grinding wheel comprising:

a plurality of abrasive grains;

a bonding material configured to bond said plurality of abrasive grains; and a plurality of grain clusters bonded with said plurality of abrasive grains and said bonding material, each grain cluster of said plurality of grain clusters including a plurality of filler grains which are accumulated, and being smaller than each abrasive grain of said plurality of abrasive grains, wherein said plurality of grain clusters each has a size which is ⅓ or more of one abrasive grain of said plurality of abrasive grains.

2. A grinding wheel comprising:

a plurality of abrasive grains;

a bonding material configured to bond said plurality of abrasive grains; and a plurality of grain clusters bonded with said plurality of abrasive grains and said bonding material, each grain cluster of said plurality of grain clusters including a plurality of filler grains which are accumulated and include chromium oxide, and being smaller than each abrasive grain of said plurality of abrasive grains, wherein said plurality of grain clusters each has a size which is ⅓ or more of each abrasive grain of said plurality of abrasive grains.

3. A method for manufacturing a grinding wheel, comprising the steps of:

accumulating a plurality of filler grains into a plurality of grain clusters; and incorporating said grain clusters into said grinding wheel, wherein each of said plurality of grain clusters has a size which is ⅓ or more of each abrasive grain of said plurality of abrasive grains.

* * * * *